US008849147B2

(12) United States Patent
Arai et al.

(10) Patent No.: US 8,849,147 B2
(45) Date of Patent: Sep. 30, 2014

(54) IMAGE FORMING APPARATUS REDUCING TONER FOGGING ON PHOTOSENSITIVE DRUM

(71) Applicants: Junichi Arai, Chiryu (JP); Hironori Akashi, Okazaki (JP)

(72) Inventors: Junichi Arai, Chiryu (JP); Hironori Akashi, Okazaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 98 days.

(21) Appl. No.: 13/623,602

(22) Filed: Sep. 20, 2012

(65) Prior Publication Data

US 2013/0077985 A1 Mar. 28, 2013

(30) Foreign Application Priority Data

Sep. 22, 2011 (JP) ..... 2011-207306

(51) Int. Cl.
*G03G 15/01* (2006.01)
*G03G 15/02* (2006.01)
*G03G 15/06* (2006.01)

(52) U.S. Cl.
CPC ..... *G03G 15/01* (2013.01); *G03G 15/06* (2013.01); *G03G 15/02* (2013.01)
USPC ..... 399/88; 399/43; 399/50; 399/89

(58) Field of Classification Search
USPC ..... 399/89, 88, 50, 43, 75, 76
See application file for complete search history.

(56) References Cited

U.S. PATENT DOCUMENTS

2007/0264034 A1* 11/2007 Kamoshida ..... 399/26
2008/0226317 A1 9/2008 Nakazawa

FOREIGN PATENT DOCUMENTS

JP 2001-235913 A 8/2001
JP 2002-196549 A 7/2002
JP 2002-365861 A 12/2002
JP 2003-140526 A 5/2003
JP 2008-224994 A 9/2008

OTHER PUBLICATIONS

Machine translation of JP 2003-140526 dated Feb. 18, 2014.*
Machine translation of JP 2008-224994 dated Feb. 18, 2014.*
Machine translation of JP 2002-365861 dated Feb. 18, 2014.*
Office Action (Notification of Reasons for Refusal) issued on Oct. 15, 2013, by the Japanese Patent Office in corresponding Japanese Patent Application No. 2011-207306, and an English Translation of the Office Action. (10 pages).

* cited by examiner

*Primary Examiner* — Sophia S Chen
(74) *Attorney, Agent, or Firm* — Buchanan Ingersoll & Rooney PC

(57) ABSTRACT

An image forming apparatus having; image supporting members provided for a plurality of colors; chargers to be impressed with charging biases to charge the respective image supporting members; developing devices to be impressed with developing biases to develop latent images formed on the image supporting members; a charging bias power supply, including high-voltage DC power supply circuits and an AC power supply circuit, for applying the charging biases, which are generated by superposition of direct-current voltages and an alternate-current voltage, to the chargers; and a control circuit that performs stop processing to stop applications of the charging biases and the developing biases. The control circuit performs processing to attenuate each of the direct-current voltages and each of the developing biases, and after all the direct-current voltages have become a predetermined stop potential, the control circuit performs processing to stop the outputs of the direct-current voltages and the alternate-current voltage.

6 Claims, 10 Drawing Sheets

IMAGE FORMING APPARATUS REDUCING TONER FOGGING ON PHOTOSENSITIVE DRUM

This application is based on Japanese Patent Application No. 2011-207306 filed on Sep. 22, 2011, the content of which is incorporated herein by reference.

BACKGROUND OF THE INVENTION

Field of the Invention

The present invention relates to an image forming apparatus, wherein photosensitive drums are charged by applications of charging biases, which are generated by superposition of direct-current voltages and an alternate-current voltage, to chargers, and wherein electrostatic latent images formed on the photosensitive drums are developed by applications of developing biases to developing devices.

There is a type of image forming apparatus that comprises charging rollers that are impressed with charging biases, which are generated by superposition of direct-current voltages and an alternate-current voltage, so as to charge photosensitive drums.

An image forming apparatus typically carries out stabilization control for the purpose of achieving appropriate charging of the photosensitive drums for Y (yellow), M (magenta), C (cyan) and K (black). High-voltage DC power supply circuits are provided separately for the respective photosensitive drums so that the stabilization control permits generations of direct-current voltages with potentials suitably adjusted for the respective colors. On the contrary, a single AC power supply circuit is shared for two or more of the photosensitive drums (for example, for the photosensitive drums for Y, M and C) so as to reduce costs. Taking monochromatic printing in consideration, another AC power supply circuit is provided only for the photosensitive drum for K (black).

Developing biases are generated by developing bias circuits provided for the sake of image formation in the respective colors. With respect to drive mechanisms for the photosensitive drums, a motor is shared for the two or more photosensitive drums for which the AC power supply circuit is shared, and another motor is provided only for the photosensitive drum for K (black).

Incidentally, as a measure to prevent toner fogging and carrier adhesion to photosensitive drums, for example, Japanese Patent Laid-Open Publication No. 2001-235913 discloses a technical skill of attenuating charging biases and developing biases step by step after color image formation.

Specifically, as shown by FIG. 7, after a lapse of 110[ms] from the completion of image formation, the charging bias potential is attenuated from −600[V] to such a value not to cause toner fogging and carrier adhesion. Subsequently, after a lapse of 120[ms] from the completion of image formation, the developing bias potential is attenuated from −550V to such a value not to cause toner fogging. This process is repeated a number of times, and finally, after a lapse of 160 [ms] from the completion of image formation, the charging bias potential and the developing bias potential fall to 0[V].

Also, as disclosed by Japanese Patent Laid-Open Publication No. 2002-196549, there is also known an image forming apparatus wherein developing bias potentials and surface potentials of photosensitive drums are attenuated step by step in case of emergency stop of the image forming apparatus so as to prevent movements of carriers from developing sleeves to the photosensitive drums.

The technical skills disclosed by Japanese Patent Laid-Open Publication No. 2001-235913 and No. 2002-196549 focus on single color. More specifically, the these patent literatures teach that the charging bias potential and the developing bias potential in association with image formation in each color are attenuated step by step. Applying such a conventional skill to an image forming apparatus wherein charging biases are generated by superposition of direct-current voltages, which are adjusted for the respective colors, and an alternate-current voltage, which is common to all the colors, causes the following problems.

As the potentials of the direct-current voltages, which are adjusted separately for the respective colors, are attenuated step by step, the direct-current voltages may become 0[V] at different times. In this case, by stopping the output of the alternate-current voltage when one of the direct-current voltages becomes 0[V] first, the potentials of all the photosensitive drums become 0[V] at the same time although the other direct-current voltages have not become 0[V]. This causes a problem that toner fogging occurs on the photosensitive drums other than the photosensitive drum for charging of which the DC voltage that became 0[V] first was used.

SUMMARY OF THE INVENTION

An image forming apparatus according to an aspect of the present invention comprises: a plurality of image supporting members provided for a plurality of colors; a plurality of chargers that are provided for the respective colors and that are configured to be impressed with charging biases so as to charge the respective image supporting members; a plurality of developing devices that are provided for the respective colors and that are configured to be impressed with developing biases so as to develop latent images formed on the respective image supporting members; a charging bias power supply including a plurality of high-voltage DC power supply circuits, which are provided for the respective colors, configured to output direct-current voltages and an AC power supply circuit, which is shared for the plurality of colors, configured to output an alternate-current voltage, the charging bias power supply applying the charging biases, which are generated by superposition of the alternate-current voltage outputted from the AC power supply circuit and the direct-current voltages outputted from the high-voltage DC power supply circuits, to the respective chargers; and a control circuit configured to perform stop processing to stop applications of the charging biases and the developing biases, wherein: the control circuit is configured to perform processing to attenuate each of the direct-current voltages outputted from the high-voltage DC power supply circuits and each of the developing biases applied to the developing devices step by step; and the control circuit is configured to perform processing to stop the high-voltage DC power supply circuits from outputting the direct-current voltages and is configured to perform to stop the AC power supply circuit from outputting the alternate-current voltage after all of the direct-current voltages outputted from the high-voltage DC power supply circuits provided for the colors, for which the AC power supply circuit is shared, have become a predetermined stop potential.

BRIEF DESCRIPTION OF THE DRAWINGS

This and other features of the present invention will be apparent from the following description, with reference to the accompanying drawings, in which.

DETAILED DESCRIPTION OF THE PREFERRED EMBODIMENTS

Figure 1:
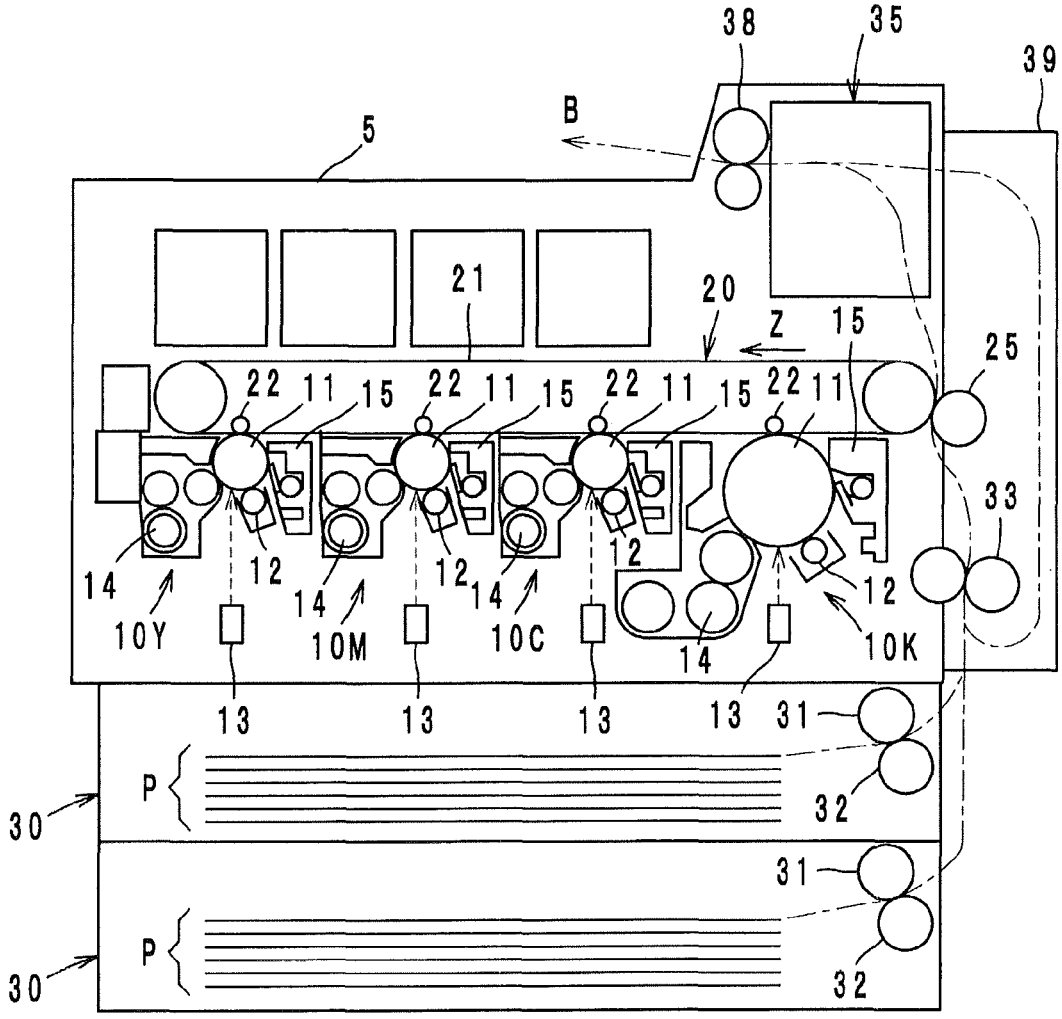
FIG. 1 is a skeleton framework of an image forming apparatus.

An image forming apparatus according to an embodiment of the present invention will be hereinafter described with reference to the drawing.

General Structure of the Image Forming Apparatus

FIG. 1 shows an image forming apparatus, which is, for example, a tandem type electorophotographic color printer. Alternatively, the image forming apparatus may be a color copier, a color facsimile, a multifunction peripheral or the like. The image forming apparatus generally comprises process units 10 (10Y, 10M, 10C, 10K) for forming toner images in four colors of Y, M, C and K, respectively, an intermediate transfer unit 20, a feed cassette 30 for storing recording sheets P therein, which is, for example, two-tiered, and a fixing unit 35.

Each of the process units 10 comprises a photosensitive drum 11, a charging roller 12, which is an example of a charger for charging the photosensitive drum 11, an exposure device 13, a developing device 14, and a cleaning device 15 for cleaning the photosensitive drum 11. In each of the process units 10, the photosensitive drum 11 is exposed to light emitted from the exposure device 13, and thereby an electrostatic latent image is formed on the photosensitive drum 11. The electrostatic latent image is developed into a toner image by the developing device 14. In this way, the process units 10 form images in the respective colors.

The intermediate transfer unit 20 comprises an intermediate transfer belt 21, which is an endless belt driven to rotate in a direction shown by arrow Z. First transfer rollers 22 are opposed to the respective photosensitive drums 11, and toner images formed on the photosensitive drums 11 are transferred onto the intermediate transfer belt 21 by the effects of electric fields generated by the first transfer rollers 22 such that the toner images can be combined into a full-color image on the transfer belt 21. Such an electrophotographic process is well known, and a detailed description thereof is omitted.

The feed unit 30 is located in a lower part of the image forming apparatus. The recording sheets P stored in the feed unit 30 are fed out thereof one by one. Each of the recording sheets P is fed out of the feed unit 30 through a nip portion between a feed-out roller 31 and a separation roller 32 of the feed unit 30. The recording sheet P fed out of the feed unit 30 is conveyed to a pair of timing rollers 33 and further to a nip portion between the intermediate transfer belt 21 and a secondary transfer roller 25, where the recording sheet P receives the toner image (the full-color image) transferred from the intermediate transfer belt 21. Thereafter, the recording sheet P is fed to the fixing device 35, where the recording sheet P is subjected to a heating treatment so that the toner can be fixed thereon. Then, the recording sheet P is ejected onto a tray 5, which is located on an upper surface of the image forming apparatus, through a pair of ejection rollers 38.

Additionally, a conveyance unit 39 for double-side printing, which is an example of optional devices, may be attached to a side of the image forming apparatus. In a double-side printing job, after image formation on a first side of a recording sheet P, the recording sheet P is once fed outward through the pair of ejection rollers 38 as shown by arrow B. Thereafter, the pair of ejection rollers 38 is rotated in the reverse direction, whereby the recording sheet P is fed backward in the opposite direction to arrow B and fed to the pair of timing rollers 33 again through the conveyance unit 39. Subsequently, an image is formed on a second side of the recording sheet P in the same way as on the first side of the recording sheet P.

Charging Bias Supply and Drive Sources for the Photosensitive Drums

Figure 2:
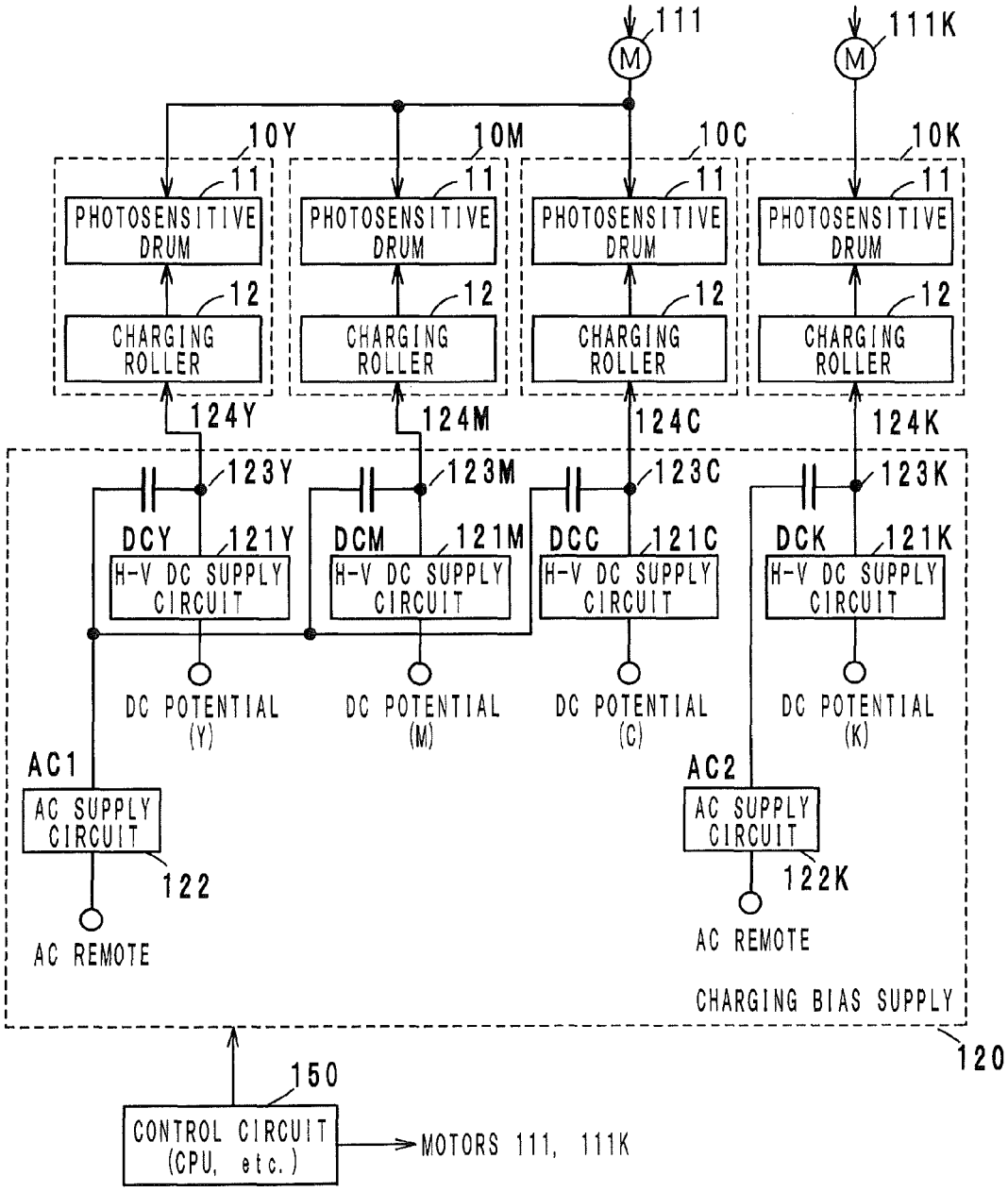
FIG. 2 is a frame format of a charging bias power supply and motors for driving photosensitive drums.

As shown by FIG. 2, the image forming apparatus further comprises a charging bias power supply 120, two motors 111 and 111K serving as drive sources for the photosensitive drums 11, and a control circuit 150 including a CPU, a ROM, etc.

The charging bias power supply 120 generally comprises high-voltage DC power supply circuits 121 (121Y, 121M, 121C, 121K) provided for the respective colors Y, M, C and K, an AC power supply circuit 122 shared for two or more of the colors (for example, for the three colors Y, M and C), and an AC power supply circuit 122K provided for black.

The high-voltage DC power supply circuits 121Y, 121M, 121C and 121K are controlled by the control circuit 150 to output direct-current voltages with variable potentials (which will be hereinafter referred to as charging direct-current voltages) DCY, DCM, DCC and DCK, respectively. Since the characteristics of toners in the respective colors are different from one another, stabilization control is carried out separately for the respective colors so that the potentials of the charging direct-current voltages, for the respective colors can be adjusted independently of one another. Therefore, as described above, separate high-voltage DC power supply circuits 121 are provided for the respective colors.

The AC power supply circuits 122 and 122K, which are, for example, AC transformers, are controlled by the control circuit 150 to output alternate-current voltages (which will be hereinafter referred to as charging alternate-current voltages) AC1 and AC2, respectively. Unlike the high-voltage DC power supply circuits 121, the AC power supply circuit 122 is shared for two or more of the colors so as to reduce costs. In this embodiment, while the AC power supply circuit 122K is provided only for black, the AC power supply circuit 122 is shared for the other colors Y, M and C.

Output terminals of the AC power supply circuit 122 are connected to output terminals of the high-voltage DC power supply circuits 121Y, 121M, and 121C via capacitors. In this embodiment, the connecting points between the output terminals of the AC power supply circuit 122 and the output terminals of the high-voltage DC power supply circuits 121Y, 121M, and 121C serve as superposing parts 123Y, 123M and 123C. At the superposing parts 123Y, 123M and 123C, the charging alternate-current voltage AC1 is superposed onto the charging direct-current voltages DCY, DCM and DCC, whereby charging biases 124Y, 124M and 124C for the respective colors Y, M and C are generated. The charging biases 124Y, 124M and 124C are applied to the corresponding charging rollers 12 provided in the process units 10Y, 10M and 10C.

An output terminal of the AC power supply circuit 122K is connected to an output terminal of the high-voltage DC power supply circuit 121K via a capacitor. In this embodiment, the connecting point between the output terminal of the AC power supply circuit 122K and the output terminal of the high-voltage DC power supply circuit 121K serves as a superposing part 123K. By the superposing part 123K, the charging alternate-current voltage AC2 is superposed onto the charging DC voltage DCK, whereby a charging bias 124K for black is generated. The charging bias 124K is applied to the corresponding charging roller 12 provided in the process unit 10K.

The motor 111 is shared for the two or more colors (for the three colors of Y, M and C). The motor 111 is controlled by the control circuit 150 to generate drive forces to rotate the photosensitive drums 11 for the two or more colors. The motor 111K is controlled by the control circuit 150 to generate a drive force to rotate the photosensitive drum 11 for black.

A developing bias power supply is not a major part of this embodiment and therefore is not shown in FIG. 2. However, the developing bias power supply is briefly described here. The developing bias power supply comprises high-voltage DC power supply circuits provided separately for the colors Y, M, C and K. The high-voltage DC power supply circuits are controlled by the control circuit 150 to output developing biases with variable potentials. The developing biases are applied to developer support members provided in the developing devices 14 for the respective colors.

Color Image Formation

In the structure above, at the start of color image formation, the control circuit 150 carries out stabilization control, whereby the potentials of the developing biases for the respective colors and the potentials of the charging direct-current voltages DC for the respective colors are determined. First, the potentials of the developing biases are determined on the basis of the amounts of toner to adhere to the photosensitive drums 11, and the potentials of the developing biases are set to such values not to cause toner fogging and carrier adhesion (for example, ±50[V]). The potentials of the charging direct-current voltages DCY, DCM, DCC and DCK are set to values obtained by adding a specified allowance to such potentials to cause toner adhesion onto the photosensitive drums 11 by applications of the developing biases. For example, the potentials of the charging direct-current voltages DCY, DCM, DCC and DCK are set to −500V, −300V, −400V and −700V, respectively. The photosensitive drums 11 are rotated by the motors 111 and 111K, and simultaneously, the charging biases 124, which are generated by superposing the charging alternate-current voltages AC onto the charging direct-current voltages DC for the respective colors, are applied to the corresponding charging rollers 12 in the respective process units 10. Thereby, the surfaces of the photosensitive drums 11 are charged with voltages, for example, with the potentials above.

Stoppage of the Charging Bias Supply and Other Devices

On completion of color image formation, the control circuit 150 carries out stop processing to stop the charging bias power supply 120 and the motors 111 and 111K, according to a program stored in the ROM or the like. The stop processing is described below with reference to FIGS. 3, 4A and 4B.

Figure 3:
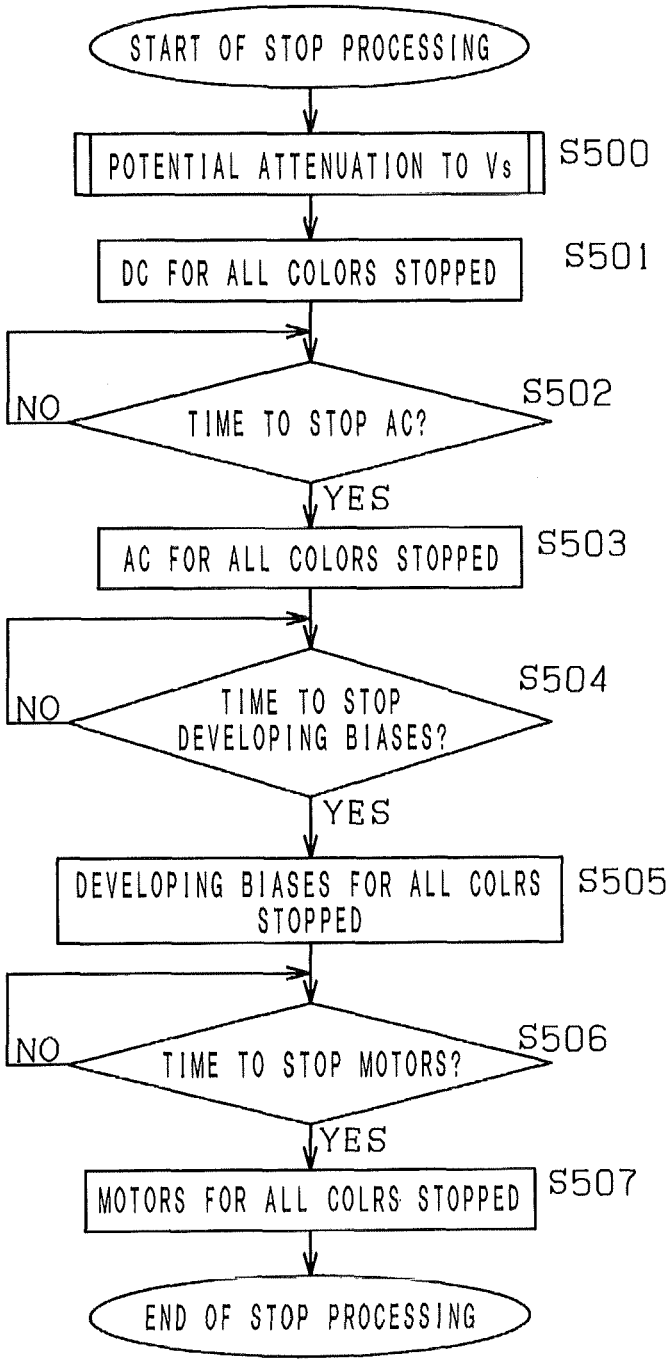
FIG. 3 is a flowchart showing stop processing to stop the image forming apparatus.

Referring to FIG. 3, at step S500, the control circuit 150 attenuates the charging direct-current voltages DC and the developing biases for the colors Y, M and C to predetermined values step by step. Actually, the processing at step S500 is performed also for black. As described above, the AC power supply circuit 122K for black is provided separately from the AC power supply circuit for the other three colors. Therefore, the stop processing to stop the components of the charging bias power supply for black is carried out in a conventional manner. In other words, the stop processing to stop the components of the charging bias power supply for black is not a major part of this embodiment. Hence, the detailed processing at step S500 will be described in connection with the colors Y, M and C.

Figure 4A:
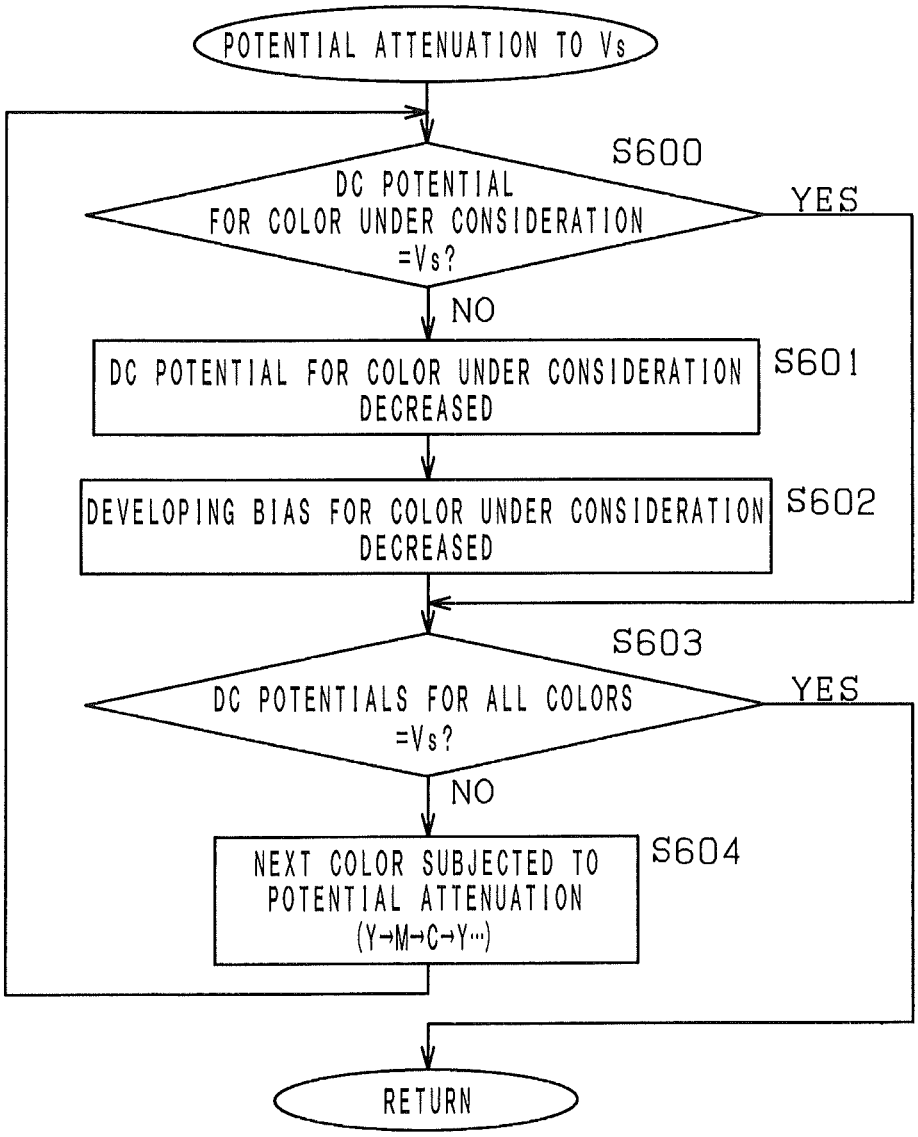
FIG. 4A is a flowchart showing processing carried out at step S500 shown in FIG. 3.

FIG. 4A shows the processing at step S500 in detail. In the program, the order of the colors to be subjected to the attenuation processing (for example, Y, M and C in this order) is stored, and at step S600 shown in FIG. 4A, the control circuit 150 checks whether the charging direct-current voltage DC for a color under consideration has fallen to a stop potential Vs. The stop potential Vs is not 0[V] and is, for example, the minimum potential with which the surfaces of the photosensitive drums 11 can be charged. Alternatively, the stop potential Vs may be a potential value which is determined from the performance of the high-voltage DC power supply circuits 121. In this embodiment, the stop potential Vs is −100V.

If the result at step S600 is "NO", by the order of the control circuit 150, the potential of the charging direct-current voltage DC for a color under consideration is decreased by such a value not to cause toner fogging and carrier adhesion. In this embodiment, the amount Δ of decreasing the potential at step S601 is, for example, 50[V]. Also, the stop processing is so programmed that the processing at step S601 is performed substantially every 10[ms]. The amount Δ of the decrease in the potential is such that carrier adhesion and toner fogging will not occur even with large variations in the position of the photosensitive drum 11 subjected to the control (large variations in the control timing).

Figure 7:
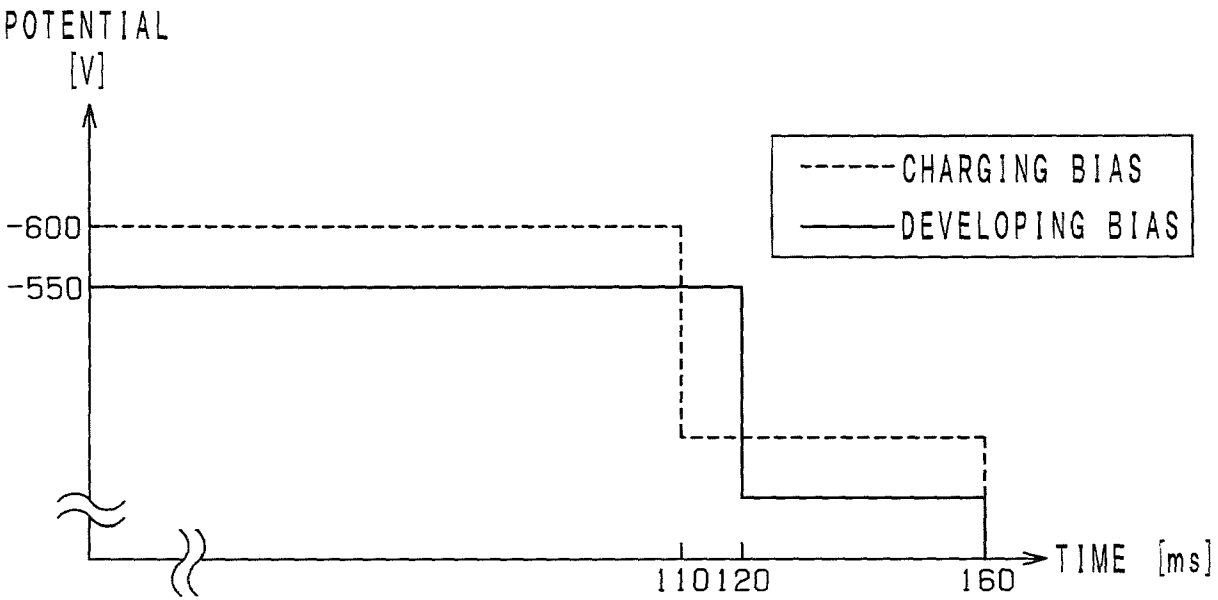
FIG. 7 PRIOR ART
FIG. 7 is a chart showing changes in a charging bias and in a developing bias with elapse of time according to a conventional method.

Next, by the order of the control circuit 150, the potential of the developing bias for the color under consideration is decreased by such a value not to cause toner fogging and carrier adhesion. In this embodiment, the amount Δ of decreasing the developing bias potential at step S602 is 50[V]. The decreases in the potential at step S601 and S602 are performed so as not to cause toner adhesion and toner fogging and may be performed in such a manner as shown by FIG. 7. Therefore, detailed descriptions of the potential decreases at steps S601 and S602 are omitted here.

After the processing at step S602 is completed or if the determination at step S600 is "YES", the control circuit 150 judges at step S603 whether all of the charging direct-current voltages DC for the colors for which the AC power supply circuit 122 is shared (that is, for the colors Y, M and C) have fallen to the stop potential Vs. If the determination at step S603 is "NO", the control circuit 150 selects, at step S604, the next color as a color under consideration. Then, the processing returns to the step S600. On the other hand, if the determination at step S603 is "YES", the control circuit 150 completes the processing shown by FIG. 4A and proceeds to step S501 shown in FIG. 3.

Figure 4B:
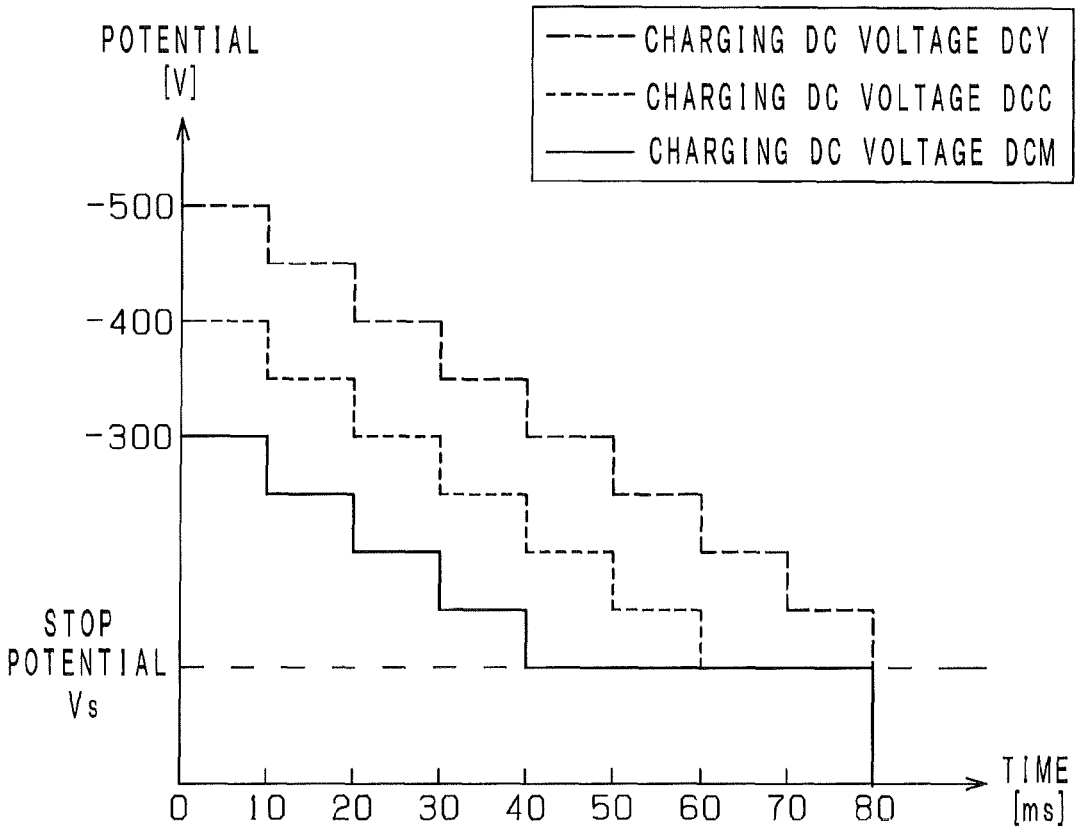
FIG. 4B is a chart showing changes in direct-current voltages of charging biases (in charging direct-current voltages) with elapse of time as a result of the processing shown by FIG. 4A.

Now, referring to FIG. 4B, an example of changing the charging direct-current voltages DCY, DCC and DCM with elapse of time is described. In the example shown by FIG. 4B, the time of completion of color image formation is taken as a reference time, that is, time 0[ms], and the charging direct-current voltages DCY, DCC and DCM at the time 0[ms] are −500 [V], −400 [V] and −300 [V], respectively, which are the same as in the above-mentioned example.

As the potential attenuation processing shown by FIG. 4A is performed, the charging direct-current voltages DCM, DCC and DCY fall to the stop potential Vs in this order. After having fallen to the stop potential Vs, the charging direct-current voltages DCM and DCC are kept at the stop potential Vs until the charging DC voltage DCY falls to the stop potential Vs.

In a case that the charging direct-current voltages DCY, DCC and DCM have the same potential at the time of completion of color image formation, the charging direct-current voltages DCY, DCC and DCM fall to the stop potential Vs substantially at the same time.

Not shown in FIG. 4B, the charging direct-current voltage DCK is also attenuated in the same manner. The point of this embodiment is the control of the DC power supply circuits 121Y, 121M and 121C, which are provided separately for the respective colors Y, M and C, and the AC power supply circuit 122, which is shared for the colors Y, M and C. Since the control of the DC power supply circuit 121K and the AC power supply circuit 122K for black is not the point of this embodiment, changes in the charging direct-current voltage DCK with elapse of time are not shown in FIG. 4B.

Referring back to FIG. 3, by the time of execution of step S501, the charging direct-current voltages for all of the colors Y, M and C have fallen to the stop voltage Vs. Therefore, at step S501, the control circuit 150 sends a control signal so as to stop the high-voltage DC power supply circuits 121 for all of the colors Y, M and C, whereby the output potentials of the high-voltage DC power supply circuits 121 become 0[V].

Next, the control circuit 150 judges at step S502 whether it is the time to stop the AC power supply circuits 122 and 122K. The timing of stoppage of the AC power supply circuits 122 and 122K is determined in consideration for the fall characteristics of the AC power supply circuits 122 and 122K in response to a stop of voltage application. The timing of stoppage of the AC power supply circuits 122 and 122K may be determined also in consideration for any other characteristics of the AC power supply circuits 122 and 122K.

If the determination at step S502 is "NO", the control circuit 150 repeats the processing at step S502. On the other hand, if the determination at step S502 becomes "YES", the processing goes to step S503, where the control circuit 150 sends a control signal to an AC remote of the AC power supply circuit 122 so as to stop the output of the charging alternate-current voltage AC1. Thereby, the charging bias potentials 124Y, 124M and 124C become 0[V] at the same time. Further, the control circuit 150 sends a control signal to an AC remote of the AC power supply circuit 122K so as to stop the output of the charging alternate-current voltage AC2. Thereby, the charging bias potential 124K becomes 0[V].

Next, the control circuit 150 judges at step S504 whether it is the time to stop the developing biases. On each of the photosensitive drums 11, the charging point and the developing point are located in different positions, and the timing of stoppage of the developing biases is determined based on the positional relation between the charging roller 12 and the developing device 14.

If the determination at step S504 is "NO", the control circuit 150 repeats the processing at step S504. On the other hand, if the determination at step S504 becomes "YES", the processing goes to step S505, where the control circuit 150 performs processing to stop the developing biases for all of the colors.

Next, the control circuit 150 judges at step S506 whether it is the time to stop the motors 111 and 111K. As the timing of stoppage of the motors 111 and 111K is, for example, a moment immediately after the stoppage of all the developing biases. If the determination at step S506 is "NO", the control circuit 150 repeats the processing at step S506. On the other hand, if the result at step S506 becomes "YES", the processing goes to step S507, where the control circuit 150 performs processing to stop the motors 111 and 111K. Thereby, the rotations of all the photosensitive drums 11 are stopped.

First Modification of the Potential Attenuation Processing

Figure 5A:
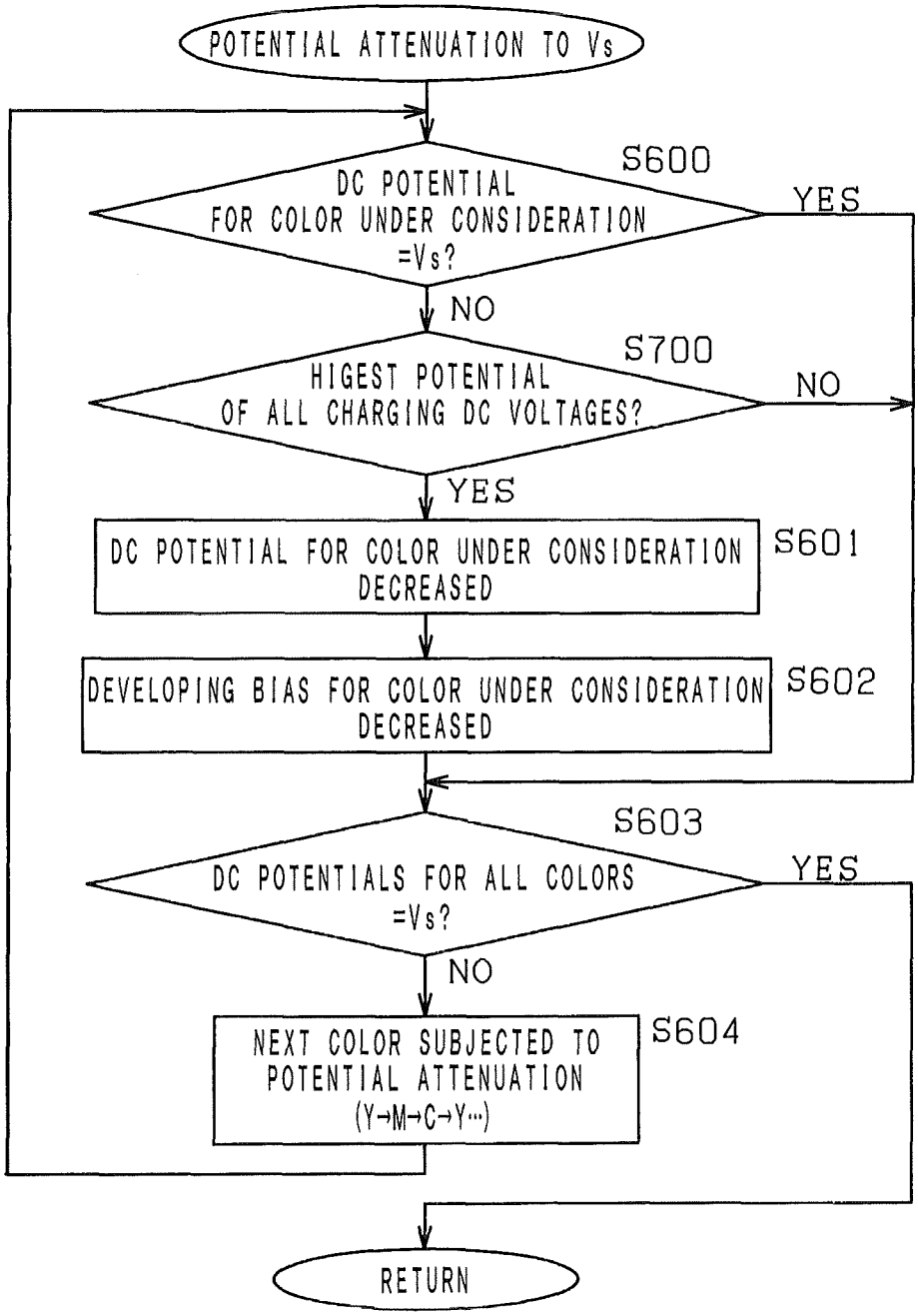
FIG. 5A is a flowchart showing a first modification of the processing carried out at step S500 shown in FIG. 3.
Figure 5B:
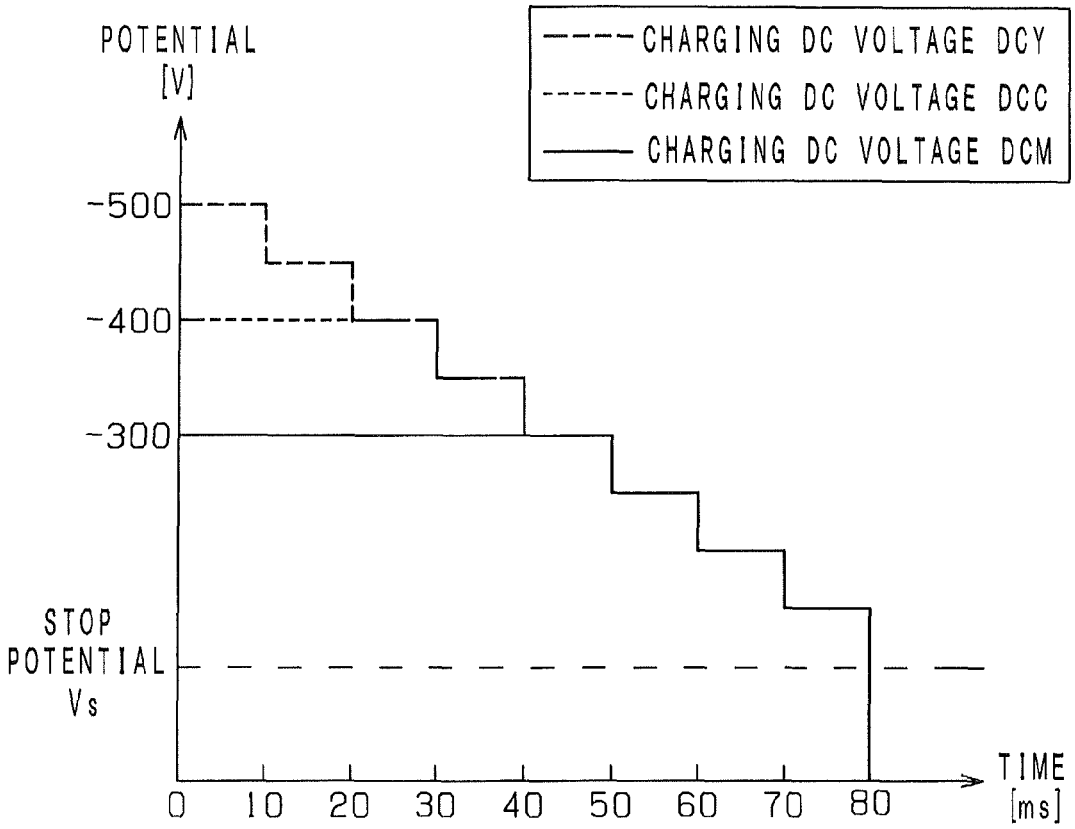
FIG. 5B is a chart showing changes in the charging direct-current voltages with elapse of time as a result of the processing shown by FIG. 5A.

Now, referring to FIGS. 5A and 5B, a first modification of the potential attenuation processing, which may be alternatively carried out at step S500 in FIG. 3, is described. Compared with the flowchart shown in FIG. 4A, the flowchart shown in FIG. 5A additionally includes a step S700. Except for this point, there are no differences between the flowchart shown in FIG. 4A and the flowchart shown in FIG. 5A. In FIG. 5A, the steps also shown in FIG. 4A are provided with the same step numbers as in FIG. 4A, and descriptions of these steps are omitted.

If the determination at step S600 is "NO", the control circuit 150 judges at step S700 whether the potential of the charging direct-current voltage DC for a color under consideration is the highest of all the charging direct-current voltages for the colors for which the AC power supply circuit 122 is shared. If the determination at step S700 is "YES", the control circuit 150 performs the processing at step S601 to attenuate the charging direct-current voltage DC for the color under consideration and the processing at step S602 to attenuate the developing bias for the color under consideration. On the other hand, if the determination at step S700 is "NO", the control circuit 150 skips the steps S601 and S602 and proceeds to step S603.

By the processing above, as exemplary shown by FIG. 5B, only the charging direct-current voltage DCY, which had the highest potential (−500[V]) at the time of starting the potential attenuation processing, is decreased step by step for 20[ms]. During the period of time, the potentials of the charging direct-current voltages DCC and DCM are not decreased and are kept as they were at the time of starting the potential attenuation processing (kept at −400[V] and −300[V], respectively). Subsequently, from the time 20[ms] to the time 40[ms], the potentials of the charging direct-current voltages DCY and DCC are decreased step by step, and the potential of the charging direct-current voltage DCM is kept as it was at the time of starting the potential attenuation processing (kept at −300[V]). After the time 40[ms], the potentials of the charging direct-current voltages DCY, DCC and DCM are decreased step by step.

Second Modification of the Potential Attenuation Processing

Figure 6A:
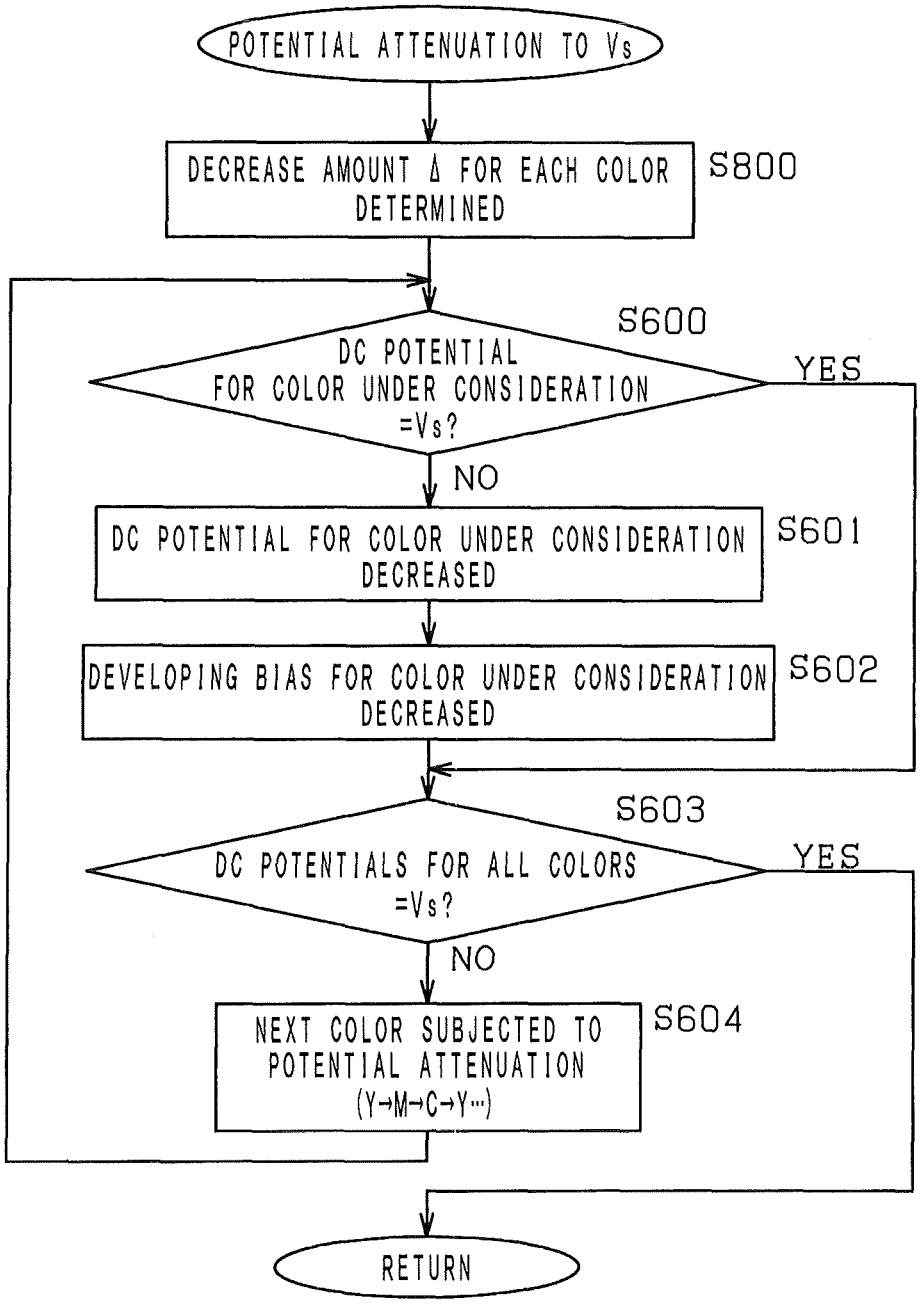
FIG. 6A is a flowchart showing a second modification of the processing carried out at step S500 shown in FIG. 3.
Figure 6B:
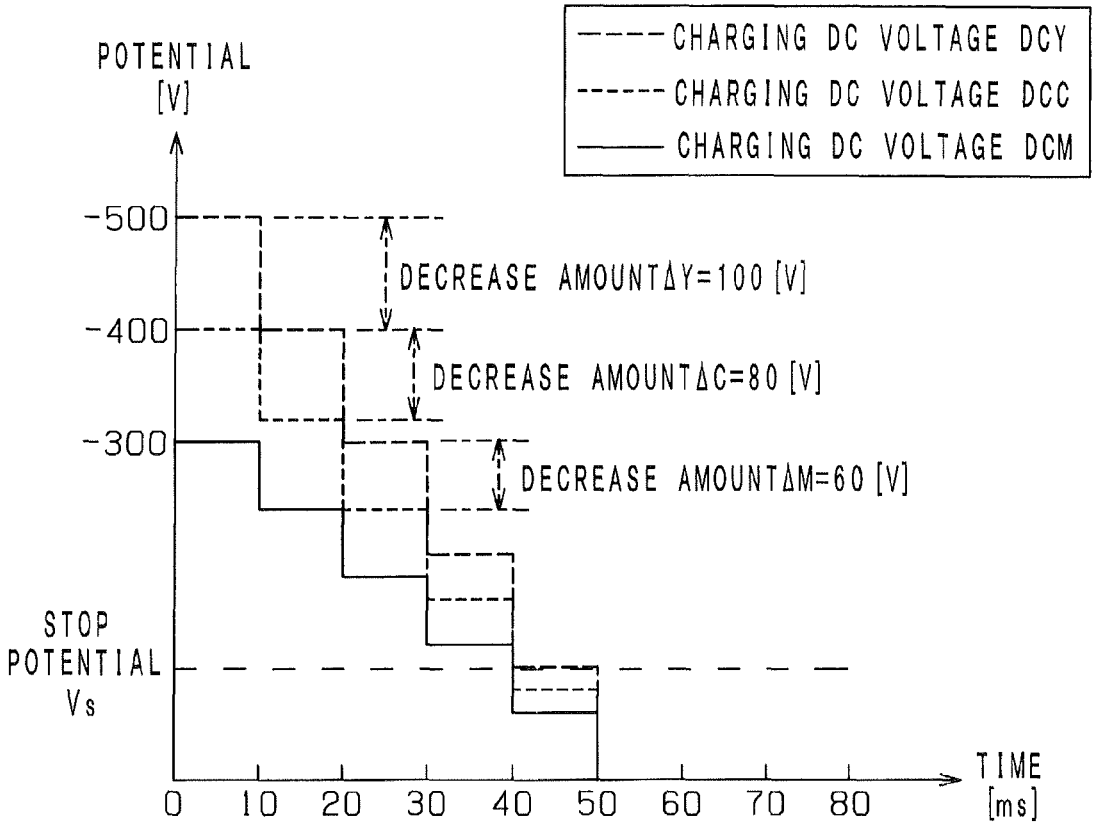
FIG. 6B is a chart showing changes in the charging direct-current voltages with elapse of time as a result of the processing shown by FIG. 6A.

Next, referring to FIGS. 6A and 6B, a second modification of the potential attenuation processing, which may be alternatively carried out at step S500 in FIG. 3, is described. Compared with the flowchart shown in FIG. 4A, the flowchart shown in FIG. 6A additionally includes a step S800. Except for this point, there are no differences between the flowchart shown in FIG. 4A and the flowchart shown in FIG. 6A. In FIG. 6A, the steps also shown in FIG. 4A are provided with the same step numbers as in FIG. 4A, and descriptions of these steps are omitted.

At step S800, the control circuit 150 determines potential decrease amounts ΔY, ΔM and ΔC of the charging direct-current voltages DCY, DCM and DCC for at least the three colors Y, M and C.

In the second modification, the decrease amounts ΔY, ΔM and ΔC are determined in the following way. In the program, some decrease amounts Δ are stored, and it is programmed to select one of the decrease amounts Δ of a charging direct-current voltage DC for one of the colors, depending on the maximum potential of the charging direct-current voltage DC. Here, the decrease amount Δ means an amount of change (decrease) in every control cycle (for 10[ms] in the example shown by FIG. 4B), that is, a rate of decrease or a slope of decrease. For example, it is programmed that the decrease amount Δ of a charging direct-current voltage DC is set as follows: if the maximum potential of the charging direct-current voltage DC is equal to or greater than −500[V], the decrease amount Δ is set to 100[V]; if the maximum potential of the charging direct-current voltage DC is equal to or greater than −400[V] and lower than −500[V], the decrease amount Δ is set to 80[V]; and if the maximum potential of the charging direct-current voltage DC is lower than −400[V], the decrease amount Δ is set to 60[V].

As the decrease amount Δ of a charging direct-current voltage DC for one of the colors used for the current color image formation, the control circuit 150 selects one from the decrease amounts Δ stored in the program, depending on the maximum potential of the charging direct-current voltage DC. For example, the control circuit 150 selects 100[V] as the decrease amount ΔY of the charging direct-current voltage DCY if the maximum potential of the charging direct-current voltage DCY is −500V.

Once the maximum potential of one of the charging direct-current voltages DC, the decrease amount Δ of the charging direct-current voltage DC, the intervals among executions of the step S601 and the stop potential Vs have been determined, it becomes possible to calculate the time when the potential of the charging direct-current voltage DC will become the stop potential Vs. Under the conditions that the maximum potential of one of the charging direct-current voltages DC is −500 [V], that the decrease amount Δ is 100[V], that the intervals among executions of the step S601 is 10[ms] and that the stop potential Vs is −100[V], it is calculated that the potential of the charging direct-current voltage DC will become the stop potential Vs at the time 40[ms].

The control circuit 150 determines the decrease amounts Δ of the other charging direct-current voltages DC for the other two colors such that the potentials of the charging direct-current voltages DC can become the stop potential Vs at the calculated time. In the example above, the decrease amount ΔC of the charging direct-current voltage DCC and the decrease amount ΔM of the charging direct-current voltage DCM are set to 80[V] and 60[V], respectively.

In this way, the decrease amounts Δ of the charging direct-current voltages for the colors are determined at step S800. Thereafter, the control circuit 150 performs the processing at step S600, and at step S601, the control circuit 150 decreases the charging direct-current voltages DC by the determined decrease amounts Δ in every cycle until the charging direct-current voltages DC become the stop potential Vs.

According to this processing, as shown in FIG. 6B, the control circuit 150 decreases the potentials of the charging direct-current voltages DCY, DCC and DCM by 100[V], 80[V] and 60[V], respectively, at intervals of 10[ms], and when the potentials of the charging direct-current voltages DCY, DCC and DCM become the stop potential Vs, the control circuit 150 performs the processing at step S501 to stop the outputs of the charging direct-current voltages. By adjusting the decrease amounts Δ in this way, the charging direct-current voltages DCY, DCC and DCM can fall to the stop potential Vs during the same number of cycles. Consequently, the stop processing time can be shortened.

Advantages and Effects of the Stop Processing

As described above, in the image forming apparatuses according to this embodiment, the first modification and the second modification, the charging biases 124 used for charging of the photosensitive drums for different colors are generated by superposing the same alternate-current voltage onto different direct-current voltages. In such an image forming apparatus, in stopping the charging biases 124 on completion of color image formation, the control circuit 150 first stops the outputs of the direct-current voltages DCY, DCM and DCC, which vary among the colors, and next stops the output of the alternate-current voltage AC1. Thus, after the charging direct-current voltages have become 0[V], the charging alternate-current voltage is turned off. Thereby, it is possible to prevent the potential of each of the photosensitive drums from falling to 0[V] at a time. Therefore, toner fogging on the surfaces of the photosensitive drums can be suppressed.

However, as the charging biases for a plurality of colors, which have different output potentials from each other, are simply attenuated according to a conventional method, the output potentials of the charging biases become 0[V] at different times. When this conventional method is adopted in a structure wherein a drive motor is shared for a plurality of photosensitive drums, at least a photosensitive drum for which the output potential of the charging bias became 0[V] first keeps idling. The idling of the photosensitive drum induces positive charge, thereby causing toner fogging. In this embodiment, on the other hand, as shown in FIG. 3, the charging direct-current voltages DCY, DCM and DCC for a plurality of colors become 0[V] at the same time at step S501, and thereafter, the output of the charging alternate-current voltage AC1 is stopped at step S503. Therefore, none of the photosensitive drums 11 idles, and toner fogging can be suppressed.

In the embodiment above, the charging rollers 12 serve as chargers for charging the photosensitive drums 11. Alternatively, chargers using corona discharge may be used as the chargers for charging the photosensitive drums 11.

Although the present invention has been described in connection with the preferred embodiment above, it is to be noted that various changes and modifications may be possible for those who are skilled in the art. Such changes and modifications are to be understood as being within the scope of the present invention.

What is claimed is:

1. An image forming apparatus comprising:

a plurality of image supporting members provided for a plurality of colors;

a plurality of chargers that are provided for the respective colors and that are configured to be impressed with charging biases so as to charge the respective image supporting members;

a plurality of developing devices that are provided for the respective colors and that are configured to be impressed with developing biases so as to develop latent images formed on the respective image supporting members;

a charging bias power supply including a plurality of high-voltage DC power supply circuits, which are provided for the respective colors, configured to output direct-current voltages and an AC power supply circuit, which is shared for the plurality of colors, configured to output an alternate-current voltage, the charging bias power supply applying the charging biases, which are generated by superposition of the alternate-current voltage outputted from the AC power supply circuit and the direct-current voltages outputted from the high-voltage DC power supply circuits, to the respective chargers; and a control circuit configured to perform stop processing to stop applications of the charging biases and the developing biases, wherein:

the control circuit is configured to perform processing to attenuate each of the direct-current voltages outputted from the high-voltage DC power supply circuits and each of the developing biases applied to the developing devices step by step; and the control circuit is configured to stop the high-voltage DC power supply circuits from outputting the direct-current voltages in a state where all of the direct-current voltages outputted from the high-voltage DC power supply circuits provided for the colors, for which the AC power supply circuit is shared, have become a predetermined stop potential and thereafter are maintained at the predetermined stop potential and to thereafter stop the AC power supply circuit from outputting the alternate-current voltage.

2. An image forming apparatus according to claim 1, wherein:

during the processing to attenuate each of the direct-current voltages outputted from the high-voltage DC power supply circuits and each of the developing biases applied to the developing devices step by step, until one of the direct-current voltages that had a potential of a highest absolute value of all the direct-current voltages during image formation becomes the stop potential, the control circuit is configured to keep the other direct-current voltages at the stop potential; and the control circuit is configured to stop the high-voltage DC power supply circuits from outputting the direct-current voltages after the direct-current voltage that had the potential of the highest absolute value has become the stop potential.

3. An image forming apparatus according to claim 1, wherein the control circuit is configured to stop the high-voltage DC power supply circuits all together from outputting the direct-current voltages in a state where all of the direct-current voltages outputted from the high-voltage DC power supply circuits provided for the colors, for which the AC power supply circuit is shared, have become the predetermined stop potential and thereafter are maintained at the predetermined stop potential.

4. An image forming apparatus according to claim 3, further comprising a drive source that is shared for the plurality of image supporting members, wherein:

the control circuit is configured to stop the drive source after stopping the AC power supply circuit from outputting the alternate-current voltage.

5. An image forming apparatus according to claim 1, wherein during the processing to attenuate each of the direct-current voltages outputted from the high-voltage DC power supply circuits and each of the developing biases applied to the developing devices step by step, the control circuit is configured to first attenuate the direct-current voltages, except one of the direct-current voltages that had a potential of a lowest absolute value of all the direct-current voltages during image formation, to the potential of the lowest absolute value step by step and is configured to thereafter attenuate all the direct-current voltages step by step.

6. An image forming apparatus according to claim 1, wherein during the processing to attenuate each of the direct-current voltages outputted from the high-voltage DC power supply circuits and each of the developing biases applied to the developing devices step by step, the control circuit is configured to determine rates of decrease of the direct-current voltages such that all the direct-current voltages can become the stop potential concurrently.

* * * * *